US010865953B2

(12) United States Patent
Yu et al.

(10) Patent No.: US 10,865,953 B2
(45) Date of Patent: Dec. 15, 2020

(54) DUAL-PURPOSE PANEL LAMP

(71) Applicant: Ningbo Ganpe Optoelectronics Co., Ltd., Ningbo (CN)

(72) Inventors: Xiangjun Yu, Ningbo (CN); Qilin Li, Ningbo (CN); Minjie Wu, Ningbo (CN)

( * ) Notice: Subject to any disclaimer, the term of this patent is extended or adjusted under 35 U.S.C. 154(b) by 1 day.

(21) Appl. No.: 16/116,894

(22) Filed: Aug. 29, 2018

(65) Prior Publication Data

US 2019/0323668 A1 Oct. 24, 2019

(30) Foreign Application Priority Data

Apr. 19, 2018 (CN) ..... 2018 1 0354805

(51) Int. Cl.

| | |
|---|---|
| ***F21S 8/06*** | (2006.01) |
| ***F21Y 115/10*** | (2016.01) |
| ***F21S 2/00*** | (2016.01) |
| ***F21S 8/02*** | (2006.01) |
| ***F21V 21/03*** | (2006.01) |

(52) U.S. Cl.

CPC ..... *F21S 8/061* (2013.01); *F21S 2/005* (2013.01); *F21S 8/026* (2013.01); *F21V 21/03* (2013.01); *F21Y 2115/10* (2016.08)

(58) Field of Classification Search

CPC . F21S 8/061; F21S 2/005; F21S 8/026; F21Y 2115/10; F21Y 2103/10; F21V 21/03; F21V 21/005; F21V 23/06

USPC ..... 362/147

See application file for complete search history.

(56) References Cited

U.S. PATENT DOCUMENTS

2014/0211457 A1* 7/2014 Tarsa ..... F21S 8/06 362/147

* cited by examiner

*Primary Examiner* — Diane I Lee
*Assistant Examiner* — Jessica M Apenteng
(74) *Attorney, Agent, or Firm* — W&K IP

(57) ABSTRACT

Embodiments of the present disclosure disclose a lamp which comprises a driving plate, a hanging plate, and a main lamp. The driving plate comprises an elastic probe. Each of the hanging plate and the main lamp comprises a contact piece for electrically connecting with the elastic probe. The driving plate is in buckle connection with the hanging plate and the main lamp. The elastic probe on the driving plate is electrically connected to the contact piece on the hanging plate when the driving plate is engaged with the hanging plate. The elastic probe on the driving plate is electrically connected to the contact piece on the main lamp when the driving plate is engaged with the main lamp. A feasible dual-purpose panel lamp which enables more convenient installation can be provided by embodiments of the present disclosure.

10 Claims, 20 Drawing Sheets

DUAL-PURPOSE PANEL LAMP

CROSS-REFERENCE TO RELATED APPLICATIONS

This application claims priority to Chinese Patent Application No. 201810354805.4 with a filing date of Apr. 19, 2018. The content of the aforementioned applications, including any intervening amendments thereto, are incorporated herein by reference.

TECHNICAL FIELD

The present disclosure relates to the field of luminaire, and more particularly, to a dual-purpose panel lamp.

BACKGROUND OF THE PRESENT INVENTION

At present, the luminaires are generally divided into a ceiling-adhering installation type and a hanging installation type. Therefore, for different fixing types, the luminaires are also divided into two different kinds of structures, and the user needs to purchase a king according to his own needs. But if the fixing method should be changed later, the lamps would have to be replaced altogether, which results in higher replacement costs.

SUMMARY OF PRESENT INVENTION

One objective of the present disclosure is to solve some problems of the prior arts by providing a dual-purpose panel lamp which facilitates installation.

A dual-purpose panel lamp according to an embodiment comprises a driving plate, a hanging plate and a main lamp. The driving plate comprises an elastic probe. Each of the hanging plate and the main lamp comprises a contact piece for electrically connecting with the elastic probe. The driving plate is in buckle connection with the hanging plate and the main lamp. The elastic probe on the driving plate is electrically connected to the contact piece on the hanging plate when the driving plate is engaged with the hanging plate. The elastic probe on the driving plate is electrically connected to the contact piece on the main lamp when the driving plate is engaged with the main lamp.

In an embodiment, the buckle connection includes coupling the driving plate to the hanging plate or the main lamp through a slot and a limiting protrusion. One side of the slot has a notch for the limiting protrusion to extend into. The other side of the slot has a bump for limiting the limiting protrusion within the slot.

In an embodiment, an auxiliary groove is positioned away from the side having the notch. The auxiliary groove has a recess positioned near the bump.

In an embodiment, the main lamp includes a frame, a frame mounting component for mounting the frame, and an LED chip disposed at a side of the frame, and the frame mounting component is disposed on top of the LED chip.

In an embodiment, the main lamp comprises a hanging wire mounting component connected to the hanging plate and a lamp body mounting component connected to the driving plate. At least one reinforcing component is disposed in the main lamp. The hanging wire mounting component and the lamp body mounting component are both provided on the reinforcing component.

In an embodiment, the hanging plate includes a hanging plate mounting component for connecting to the driving plate and an outer cover disposed under the hanging plate mounting component. The edges of the outer cover are inclined upwardly.

In an embodiment, a background light is disposed on the hanging plate and inside the outer cover.

In an embodiment, the lamp comprises two elastic, probes, two contact pieces, four hanging wire mounting components, and four limiting protrusions.

In an embodiment, the bump is under the lower side of the slot and close to an end point of the slot.

In an embodiment, an installation method for a dual-purpose panel lamp comprises the steps of sliding the limiting protrusions on the hanging plate into the slot on the driving plate, sliding the driving plate to cause the limiting protrusions to deform the bump in the slot and push the bump into an end of the slot, electrically connecting the two elastic probes with the two contact pieces after the bump is reset, and connecting the four hanging wires on the hanging plate to the four hanging wire mounting components.

The embodiments have the following advantages compared to prior art: The electrical connection between the hanging plate and the driving plate or the main lamp and the driving plate is enabled by the cooperation between the elastic probe and the contact piece, and wiring is no longer required. The buckle connection is adopted to form a more handy mechanical connection. It is also easier to complete both the mechanical connection and the electrical connection by the buckle connection. The disclosed structure would facilitate the user during installation of the lamp.

REFERENCE NUMBERS

1, driving plate; 2, hanging plate; 3, main lamp; 4, elastic probe; 5, contact piece; 6, limiting protrusion; 7, slot; 8, notch; 9, bump; 10, auxiliary groove; 11, recess; 12, frame; 13, frame mounting component; 14, LED chip; 15, hanging wire mounting component; 16, lamp body mounting component; 17, reinforcing component; 18, hanging plate mounting component; 19 outer cover.

DETAILED DESCRIPTION OF PREFERRED EMBODIMENTS

Exemplary embodiments of the present disclosure would be described in further detail below with reference taken to the accompanying drawings.

A first embodiment of the present disclosure is shown in FIGS. 1-9, a dual-purpose panel lamp may comprise a driving plate 1, a hanging plate 2 and a main lamp 3.

Figure 1:
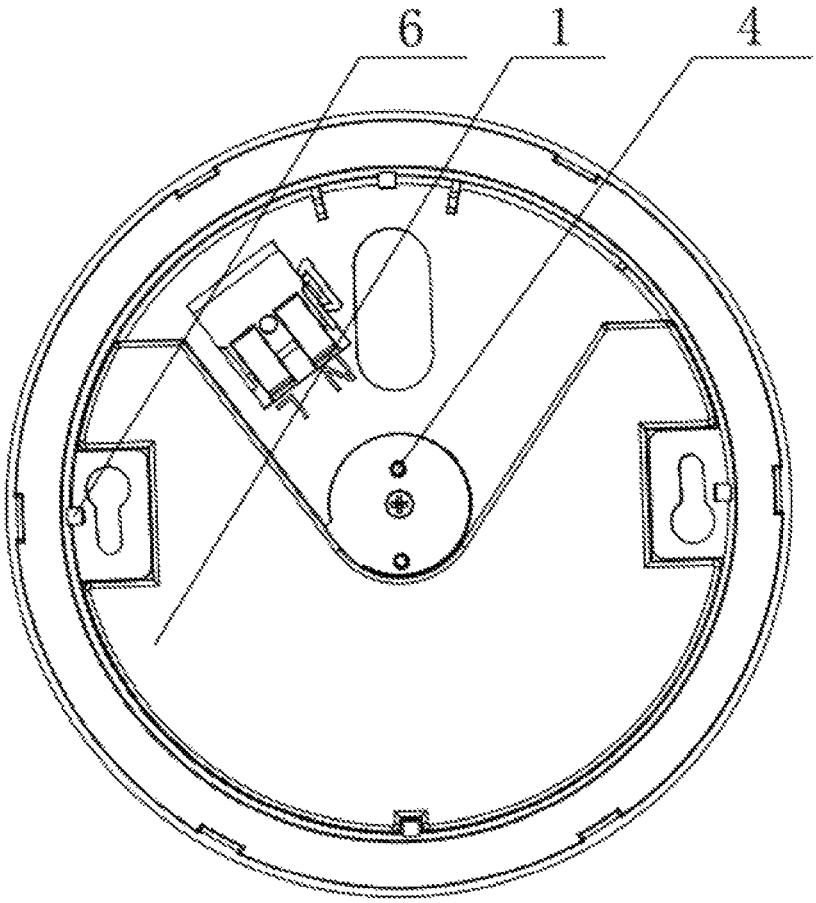
FIG. 1 is a structural schematic of a driving plate of a first embodiment of the present disclosure.

FIG. 1 shows a driving plate 1 which is usually fixed to the ceiling of a room by a fixing mechanism. The driving plate 1 comprises at least one elastic probe 4. In this embodiment, two elastic probes 4 are arranged on the driving plate 1. The two elastic probes 4 are electrically connected to the driving circuit inside the driving plate 1. The driving plate 1 is further provided with limiting protrusions 6 uniformly disposed along its circumference. In the specific embodiment, four limiting protrusions 6 are included.

Figure 2:
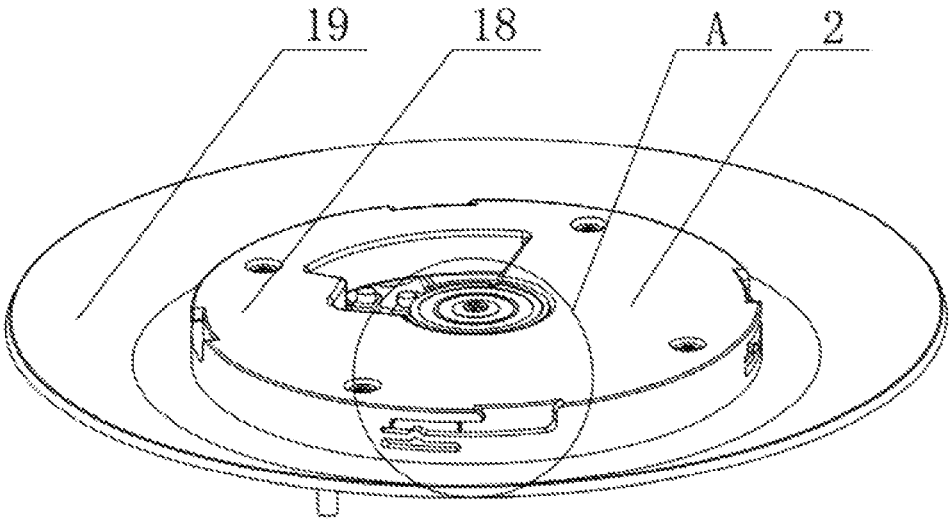
FIG. 2 is a structural schematic of a hanging plate of a first embodiment of the present disclosure.
Figure 3:
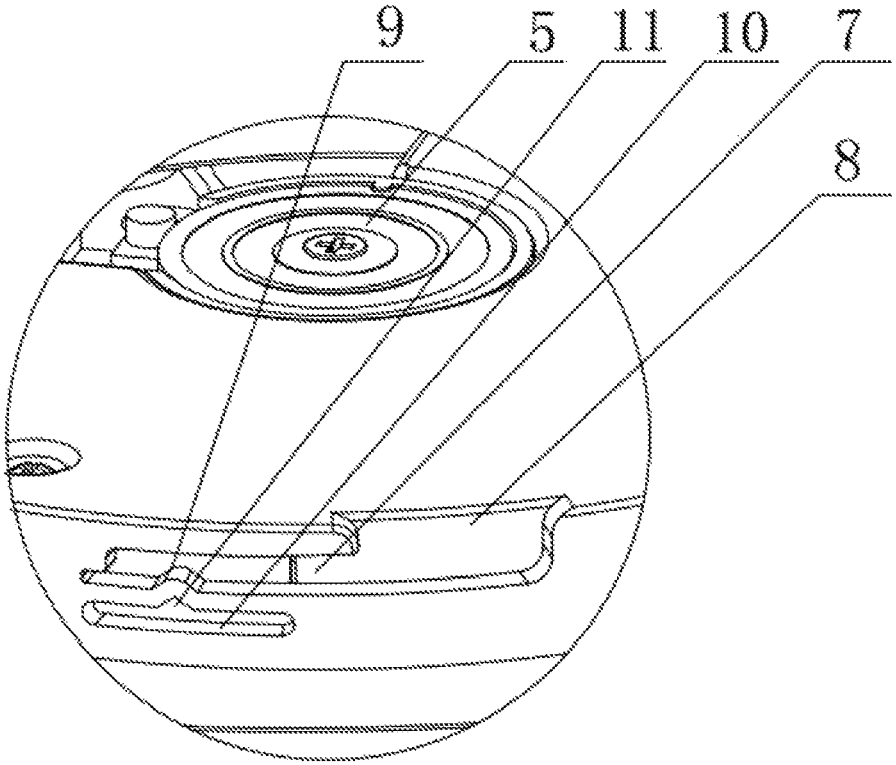
FIG. 3 is an enlarged view of a part A of FIG. 2.

As shown in FIGS. 2-3, the hanging plate 2 mainly includes a mounting component for connecting with the driving plate 1, and an outer cover 19 disposed under the mounting component of the hanging plate 2. A contact piece 5 that matches with the elastic probe 4 is disposed on top of the mounting component of the hanging plate 2.

Two contact pieces 5 are involved in this embodiment, and the distance between the two contact pieces 5 corresponds to the distance between two elastic probes 4. A plurality of fastening components are uniformly provided along the circumference of the mounting component of the hanging plate 2. In the embodiment, the number of the fastening components is the same as the number of the limiting protrusions 6 which is four Each fastening component comprises a slot 7. A notch 8 is provided on the upper side of the slot 7 for the limiting protrusion 6 to extend into. The lower side of the slot 7 has a bump 9 for limiting the limiting protrusion 6 within the slot 7. As is apparent from FIG. 3, the notch 8 is provided at the left starting point of the upper side of the slot 7. An outwardly expanding arc-shaped opening for the limit protrusion 6 on the driving plate 1 to extend into is also included. The bump 9 is disposed on right side of the lower side of the slot 7 and near its end point below the bump 9. An auxiliary groove 10 is provided below the bump 9. A recess 11 matching with the shape of the bump 9 is provided between the auxiliary groove 10 and the bump 9. A background light is also disposed on the hanging plate 2.

Figure 4:
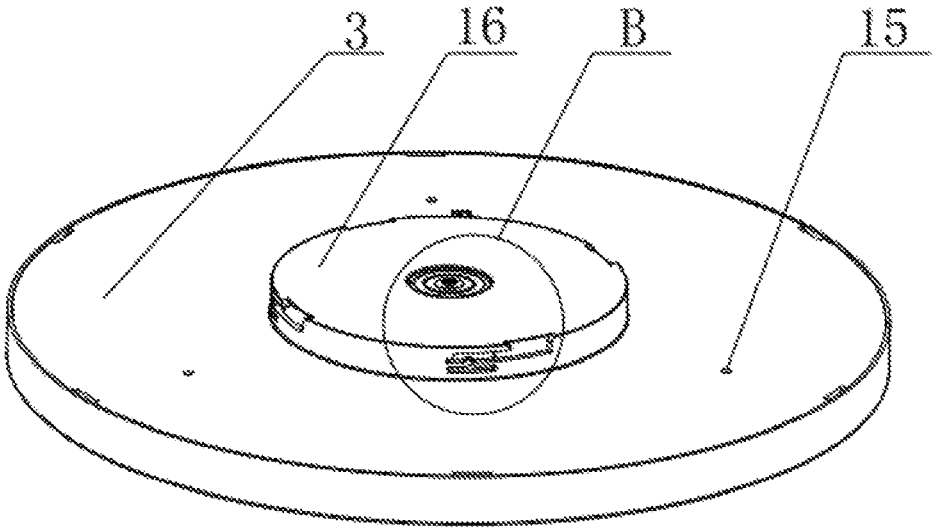
FIG. 4 is a structural schematic of a main lamp of a first embodiment of the present disclosure.
Figure 5:
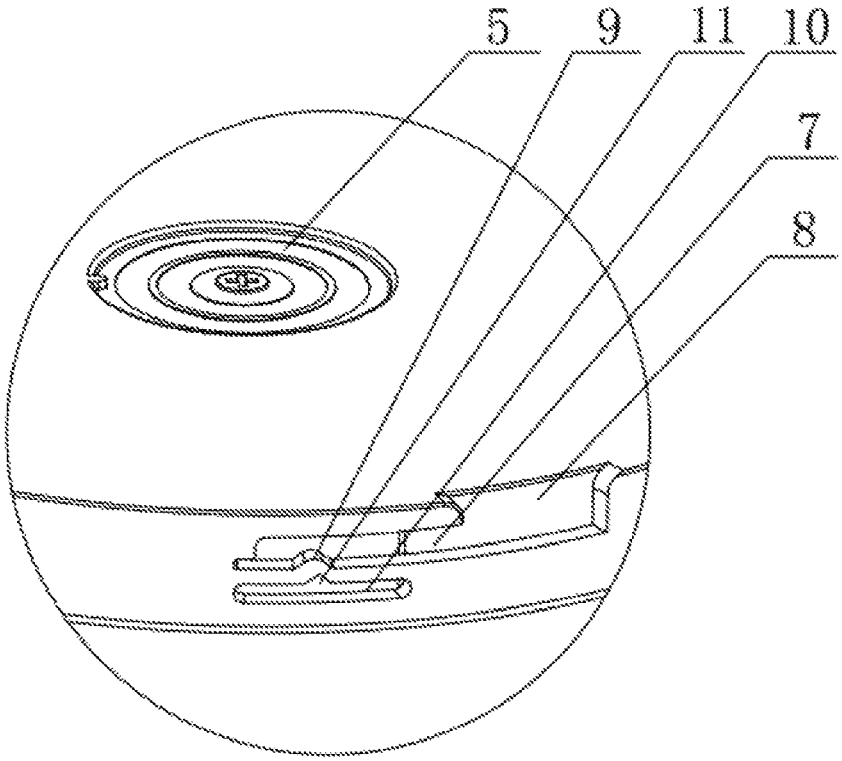
FIG. 5 is an enlarged view of a part B of FIG. 2.

As shown in FIGS. 4-5, the main lamp 3 mainly includes a main body, a lamp body mounting component 16 disposed on the main body for connecting with the driving plate 1, and a hanging wire mounting component 15 disposed on the main body for connecting with the hanging plate 2. A contact piece 5 that matches with the elastic probe 4 is disposed at the top of the lamp body mounting component 16. Two contact pieces 5 are involved in this embodiment, and the distance between the two contact pieces 5 corresponds to the distance between two elastic probes 4. A plurality of fastening components are uniformly provided along the circumference of the mounting component of the hanging plate 2. In the embodiment, the number of the fastening components is the same as the number of the limiting protrusions 6 which is four. Each fastening component comprises a slot 7. A notch 8 is provided on the upper side of the slot 7 for the limiting protrusion 6 to extend into. The lower side of the slot 7 has a bump 9 for limiting the limiting protrusion 6 within the slot 7. As is apparent from FIG. 5, the notch 8 is provided at the left starting point of the upper side of the slot 7. An outwardly expanding arc-shaped opening for the limit protrusion 6 on the driving plate 1 to extend into is also included. The bump 9 is disposed on the right side of lower side of the slot 7 and near its end point. An auxiliary groove 10 is provided below the bump 9. A recess 11 matching with the shape of the bump 9 is provided between the auxiliary groove 10 and the bump 9. The hanging wire mounting component 15 mainly comprises a plurality of hanging wire mounting members disposed on the main body. In this embodiment, three hanging wire mounting members are uniformly disposed on the circumference for installing the hanging wire on the hanging plate 2. The main body also has an interface to enable an electrical connection with any connector of conducting wires connected to the hanging plate 2.

Figure 6:
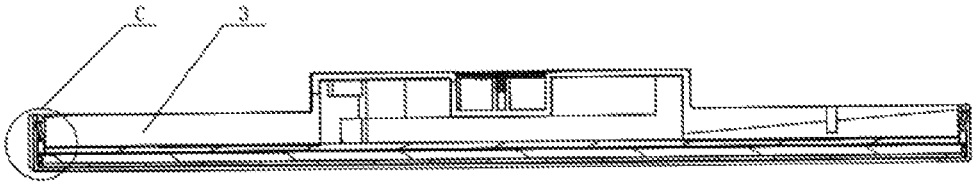
FIG. 6 is a cross-sectional view of a part B of FIG. 4.
Figure 7:
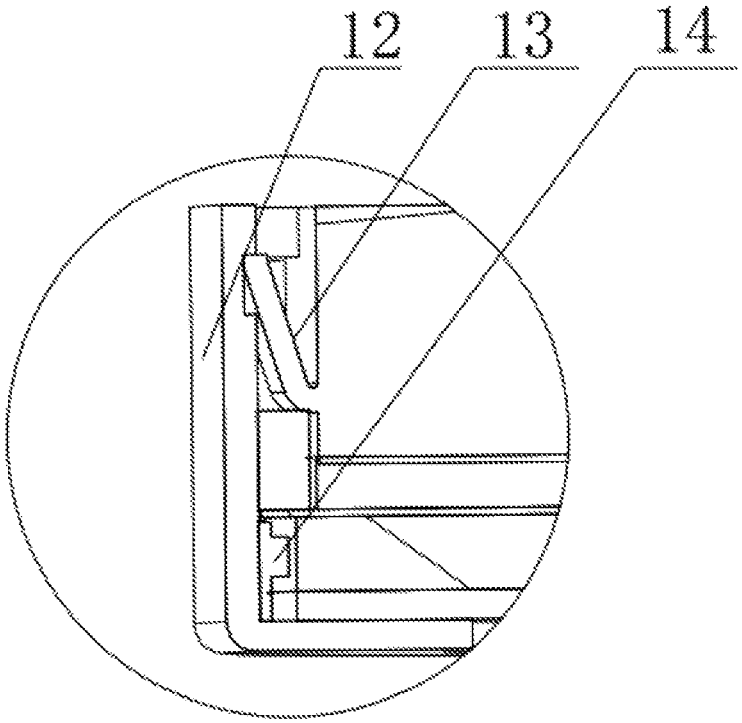
FIG. 7 is an enlarged view of a part C of FIG. 6.

As shown in FIGS. 6-7, a cross-sectional view of the main lamp 3 shows that the side of the main lamp 3 has a frame 12 on the far side, and a LED chip 14 is disposed in the frame 12. A frame mounting component 13 is installed on the top of the LED chip 14. In the embodiment, the frame mounting component 13 is a buckle. The buckle is a buckle component which extends from the plastic component at the bottom of the main lamp 32 and it is fastened to the frame 12.

Figure 8:
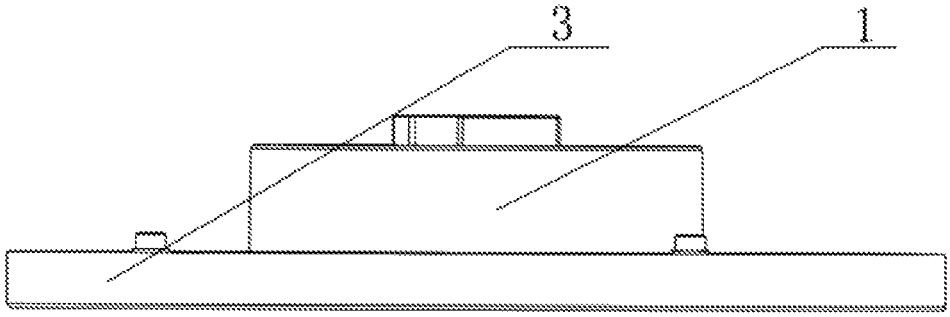
FIG. 8 is a structural schematic of a ceiling-adhering lamp of a first embodiment of the present disclosure.

FIG. 8 is a structural schematic of a ceiling-adhering lamp. The driving plate 1 can be formed in combination with the main lamp 3. The mounting method comprises the following steps: Firstly, the four limiting protrusions 6 on the driving plate 1 are inserted into the notch 8 of the slot 7 on the main lamp 3. Secondly, the driving plate 1 is rotated such that the limiting protrusions 6 on the driving plate 1 slide into the interior of the slot 7. The driving plate 1 continues to rotate until the limiting protrusions 6 on the driving plate 1 press against the bump 9 in the slot 7. Then, the limiting protrusions 6 will deform the bump 9 and push the bump 9 into the tail of the slot 7. After that, the bump 9 will be reset due to its own elastic force, and a sound of the reset bounce will be heard. At this time, the driving plate 1 and the main lamp 3 would have been assembled correctly. The two elastic probes 4 on the driving plate 1 are electrically connected to the two contact pieces 5 on the main lamp 3 after the assembly is completed. Therefore, both the mechanical and the electrical connection between the main lamp 3 and the driving plate 1 are completed at the same time.

Figure 9:
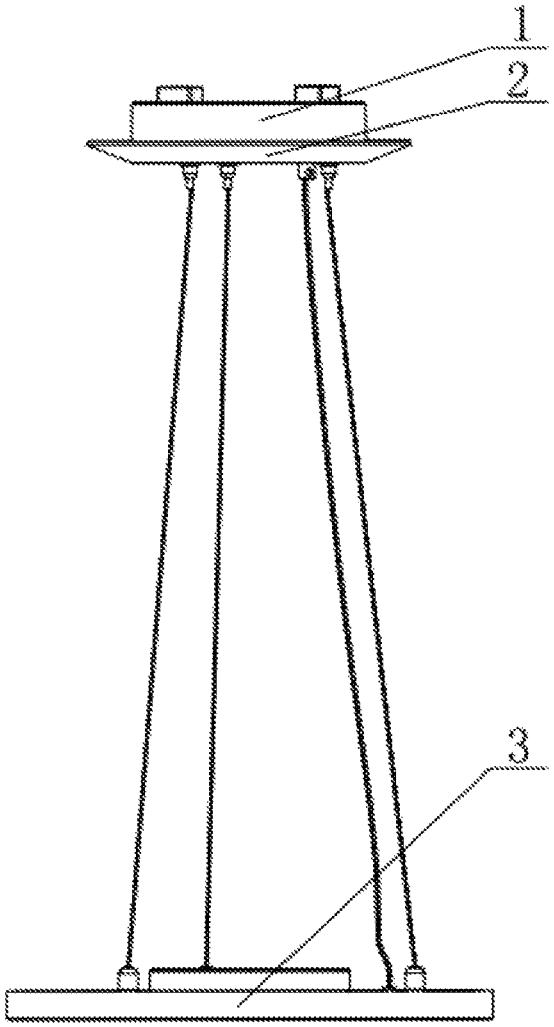
FIG. 9 is a structural schematic of a hanging lamp of a first embodiment of the present disclosure.

As shown in FIG. 9, the lamp may be a combination of a driving plate 1, a hanging plate 2 and a main lamp 3. The mounting method comprises the following steps: Firstly, the four limiting protrusions 6 on the driving plate 1 are inserted into the notch 8 of the slot 7 on the main lamp 3. Secondly, the driving plate 1 is rotated such that the limiting protrusions 6 on the driving plate 1 slide into the interior of the slot 7. The driving plate 1 continues to rotate until the limiting protrusions 6 on the driving plate 1 press against the bump 9 in the slot 7. Then, the limiting protrusions 6 will deform the bump 9 and push the bump 9 into the tail of the slot 7. After that, the bump 9 will be reset due to its own elastic force, and a sound of the reset bounce will be heard. At this time, the driving plate 1 and the main lamp 3 would have been assembled correctly. The two elastic probes 4 on the driving plate 1 are electrically connected to the two contact pieces 5 on the main lamp 3 after the assembly is completed. Then, three hanging wires on the hanging plate 2 are connected to the hanging wire mounting component 15 on the main lamp 3 and a connector of conducting wires on the hanging plate 2 is inserted into the interface to complete the installation of the lamp.

A second embodiment of the present disclosure is shown in FIGS. 10-20, a dual-purpose panel lamp may comprise a driving plate 1, a hanging plate 2 and a main lamp 3.

Figure 10:
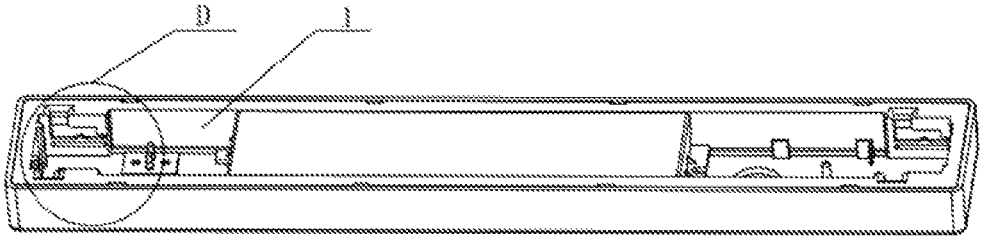
FIG. 10 is a structural schematic of a driving plate of a second embodiment of the present disclosure.
Figure 11:
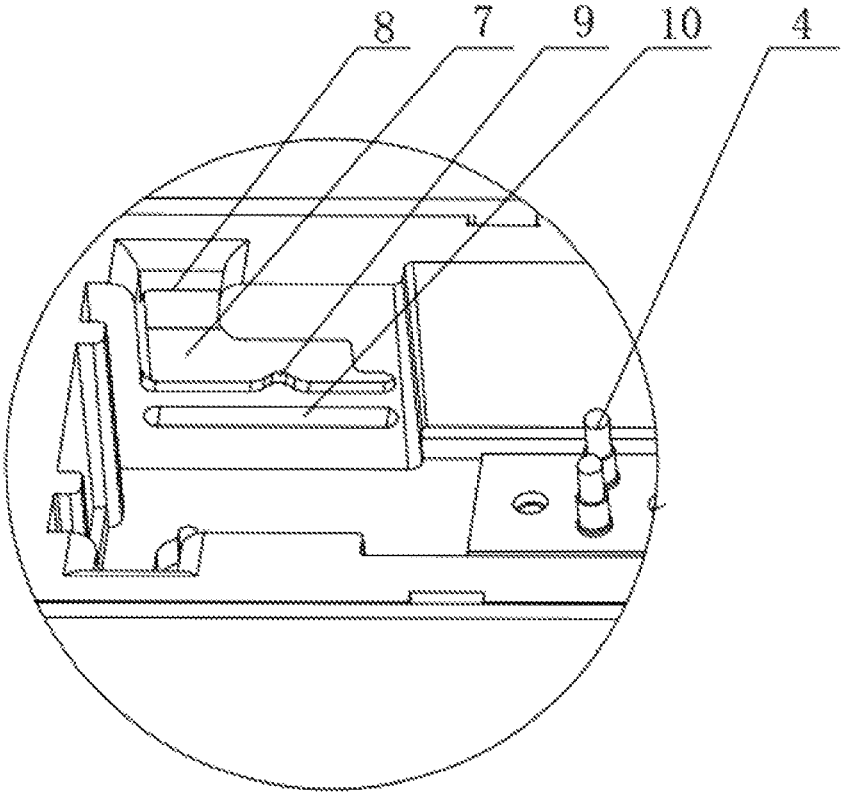
FIG. 11 is an enlarged view of a part D of FIG. 10.

FIG. 10-11 shows a driving plate 1 which is usually fixed to the ceiling of a room by a fixing mechanism. The driving plate 1 comprises at least one elastic probe 4. In this embodiment, two elastic probes 4 are arranged on the driving plate 1. The two elastic probes 4 are electrically connected to the driving circuit inside the driving plate 1. The driving plate 1 further comprises two groups of fastening components. Each group of fastening components comprises a pair of oppositely disposed fastening components. Each fastening component comprises a slot 7. A notch 8 is provided on the upper side of the slot 7 for the limiting protrusion 6 to extend into. The lower side of the slot 7 has a bump 9 for limiting the limiting protrusion 6 within the slot 7. As is apparent from FIG. 11, the notch 8 is provided at the left starting point of the upper side of the slot 7. An outwardly expanding arc-shaped opening for the limit protrusion 6 on the driving plate 1 to extend into is also included. The bump 9 is disposed on the right side of lower side of the slot 7 and near its end point. An auxiliary groove 10 is provided below the bump 9.

Figure 12:
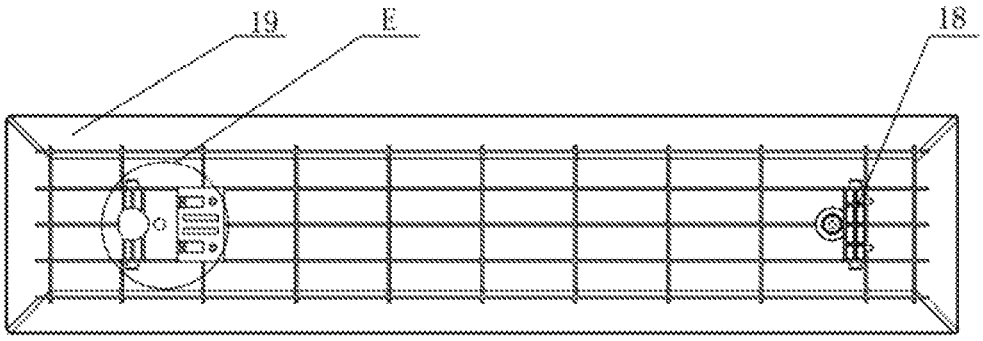
FIG. 12 is a structural schematic of a hanging plate of a second embodiment of the present disclosure.
Figure 13:
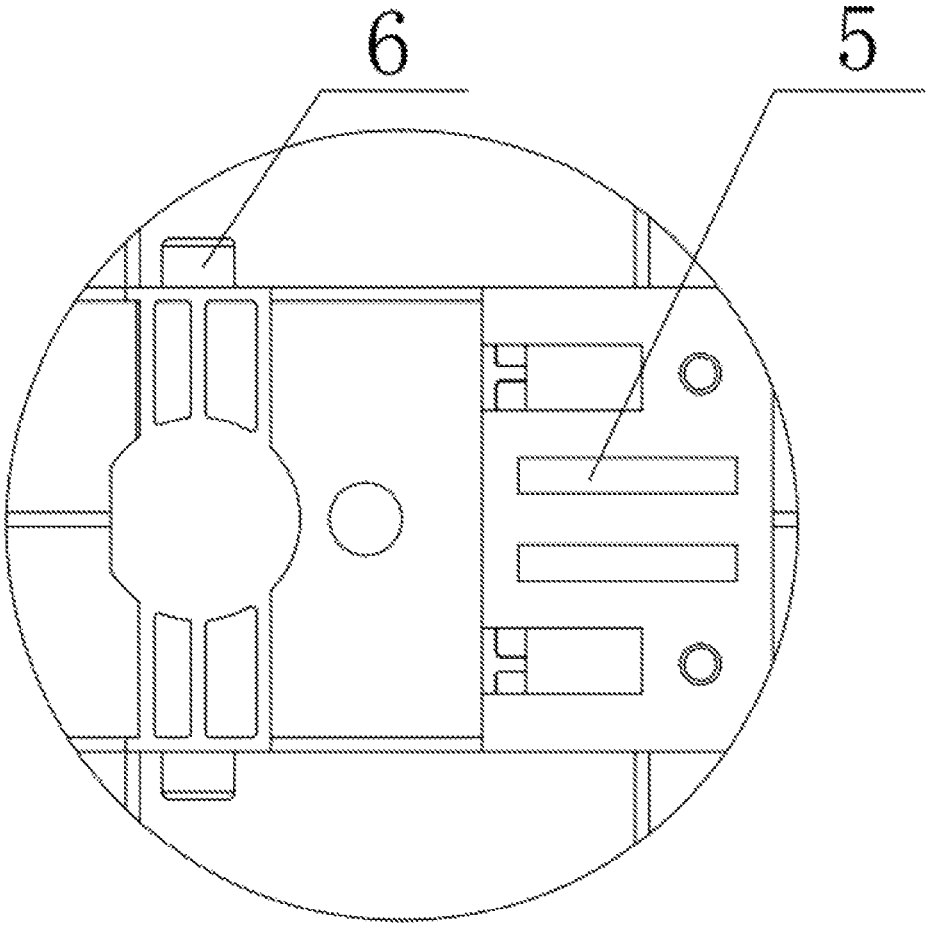
FIG. 13 is n enlarged view of a part E of FIG. 12.
Figure 14:
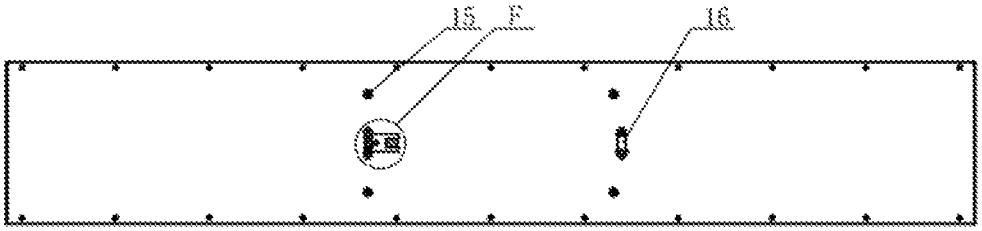
FIG. 14 is a structural schematic of a main lamp of a second embodiment of the present disclosure.
Figure 15:
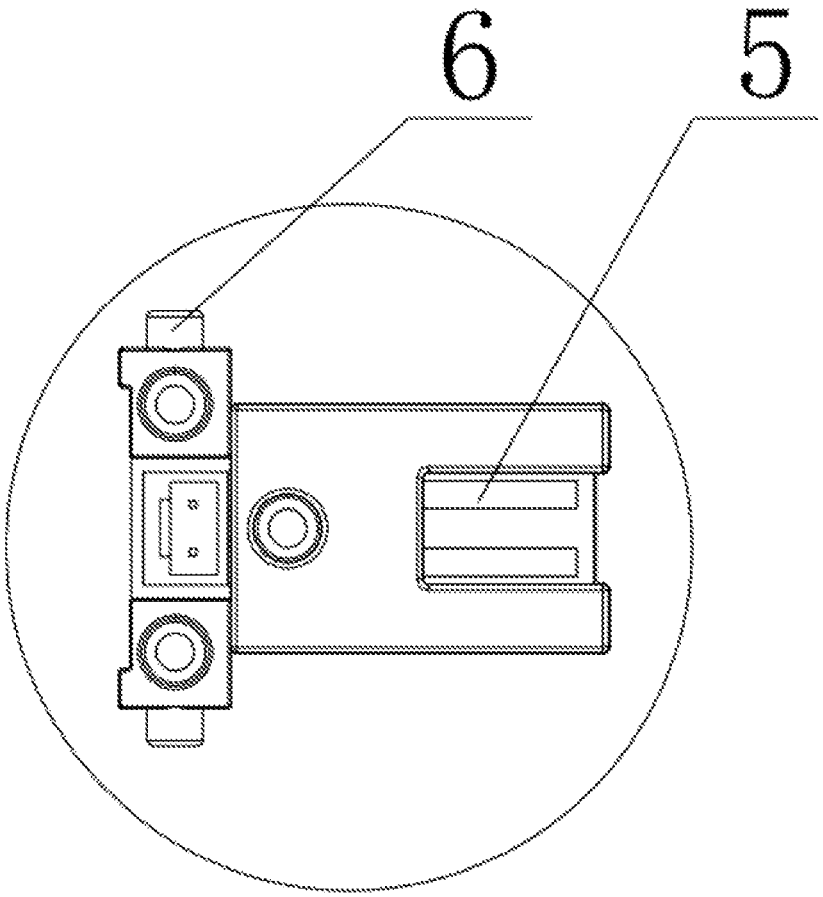
FIG. 15 is an enlarged view of a part F of FIG. 12.

As shown in FIGS. 12-13, the hanging plate 2 mainly includes a hanging plate mounting component 16 for connecting with the driving plate 1, and an outer cover 19 disposed under the hanging plate mounting component. A contact piece 5 that matches with the elastic probe 4 is disposed on top of the mounting component of the hanging plate 2. Two contact pieces 5 are involved in this embodiment, and the distance between the two contact pieces 5 corresponds to the distance between two elastic probes 4. The contact piece 5 is electrically connected to the circuits inside the hanging plate 2. The hanging plate mounting component 18 is further provided with two pairs of limiting protrusions 6 for inserting into the slot 7, and the positions of the limiting protrusions 6 are also matched to the positions of the slots 7 on the driving plate 1.

As shown in FIGS. 4-5, the main lamp 3 mainly includes a main body, a lamp, body mounting component 16 disposed on the main body for connecting with the driving plate 1, and a hanging wire mounting component 15 disposed on the main body for connecting with the hanging plate 2. A contact piece 5 that matches with the elastic probe 4 is disposed at the top of the lamp body mounting component 16. Two contact pieces 5 are involved in this embodiment, and the distance between the two contact pieces 5 corresponds to the distance between two elastic probes 4. The contact pieces 5 are electrically connected to circuits inside the main lamp 3. The lamp body mounting component 16 further comprises two pair of limiting protrusions 6 for inserting into the slot 7. The positions of the limiting protrusions 6 are also matched to the positions of the slots 7 on the driving plate 1. The hanging wire mounting component 15 mainly comprises a plurality of hanging wire mounting members disposed on the main body. In this embodiment, four hanging wire mounting members are disposed for installing the hanging wire on the hanging plate 2. The main body of the embodiment also has an interface to enable an electrical connection with any connector of conducting wires connected to the hanging plate 2.

Figure 16:
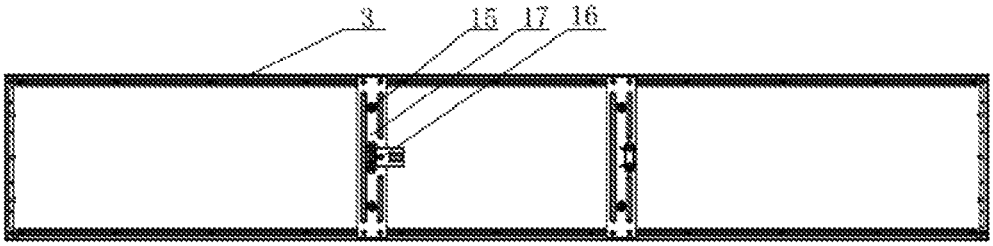
FIG. 16 is a schematic illustration of interior structures of the main lamp of the second embodiment of the present disclosure.

As shown in FIG. 16, it can be seen that the main lamp 3 is internally provided with a reinforcing component 17. In this embodiment, two reinforcing components 17 are included. The lamp body mounting component 16 and the hanging wire mounting component 15 are both disposed on the reinforcing component 17.

Figure 17:
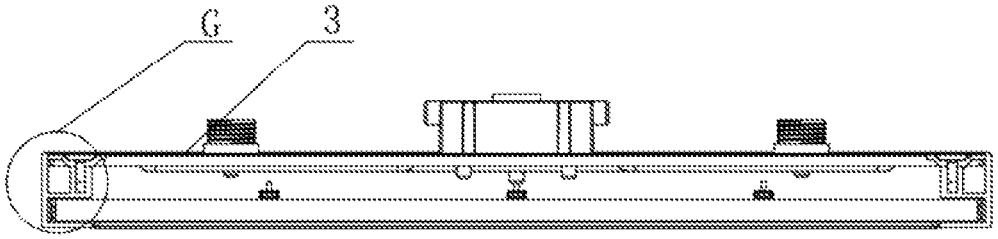
FIG. 17 is a schematic illustration of the structures of the main lamp of the second embodiment of the present disclosure without the frame.
Figure 18:
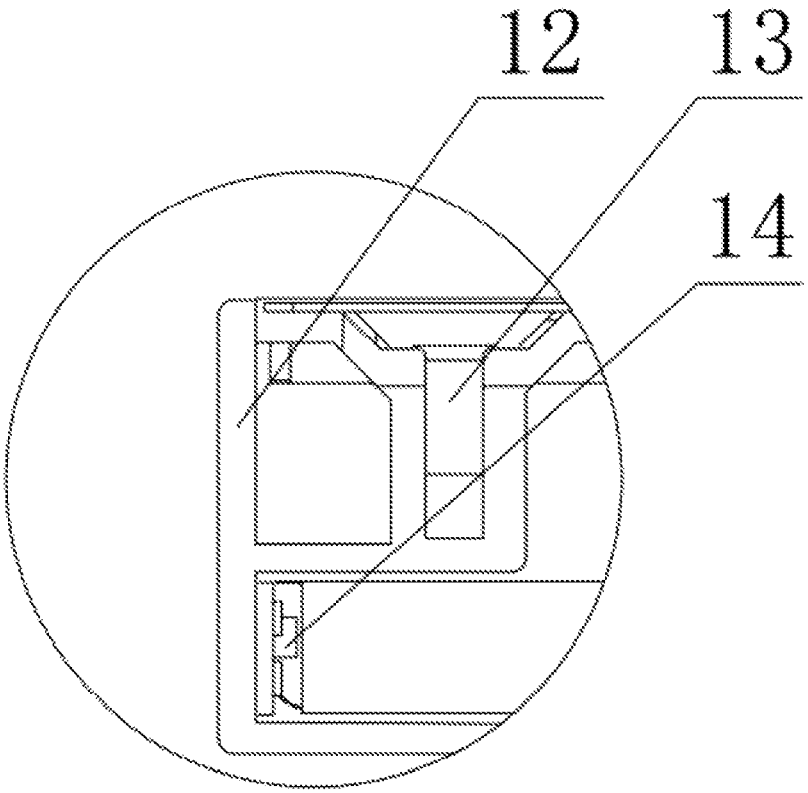
FIG. 18 is an enlarged view of a part G of FIG. 17.

As shown in FIGS. 17-18, the circumference of the main lamp 3 comprises a frame 12. A LED chip 14 is disposed on the inner walls of the frame 12. The frame 12 is fixed by a frame mounting component 13. In the embodiment, the frame mounting component 13 is a fixing screw arranged above the LED chip 14.

Figure 19:
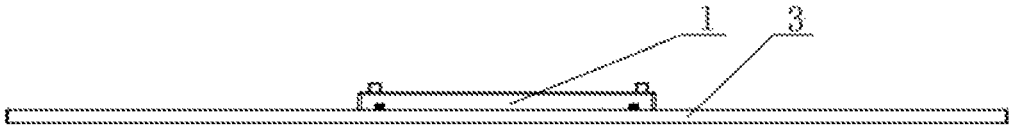
FIG. 19 is a structural schematic of a ceiling-adhering lamp of a second embodiment of the present disclosure.
Figure 20:
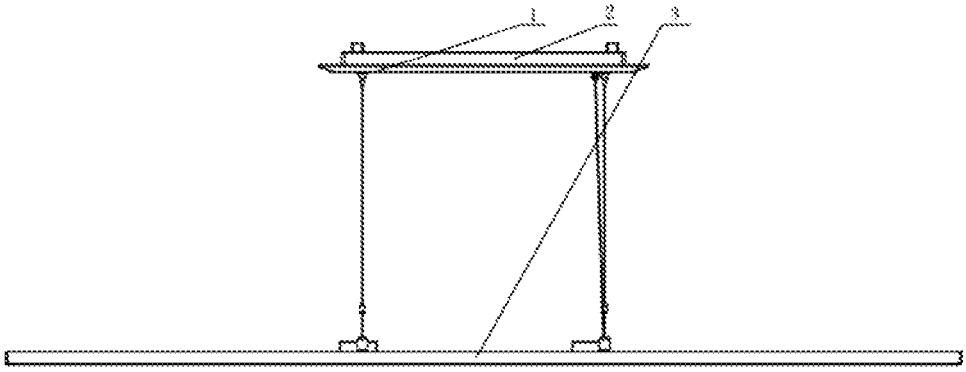
FIG. 20 is a structural schematic of a hanging lamp of a second embodiment of the present disclosure.

FIG. 19 shows a schematic view of the lamp used as a ceiling-adhering lamp when the driving plate 1 is engaged with the main lamp 3. The assembly process includes the following steps: Firstly, the four limiting protrusions 6 on the driving plate 1 are inserted into the notch 8 of the slot 7 on the main lamp 3. Secondly, the driving plate 1 is slided horizontally such that the limiting protrusions 6 on the main lamp 3 slide into the interior of the slot 7. The driving plate 1 continues to slide until the limiting protrusions 6 on the main lamp 3 press against the bump 9 in the slot 7. Then, the limiting protrusions 6 will deform the bump 9 and push the bump 9 into the tail of the slot 7. After that, the bump 9 will be reset due to its own elastic force, and a sound of the reset bounce will be heard. At this time, the driving plate 1 and the main lamp 3 would have been assembled correctly. The two elastic probes 4 on the driving plate 1 are electrically connected to the two contact pieces 5 on the main lamp 3 after the assembly is completed. Therefore, both the mechanical and the electrical connection between the main lamp 3 and the driving plate 1 are completed at the same time.

FIG. 19 shows a schematic view of the lamp used as a ceiling-adhering lamp when the driving plate 1 and the hanging plate 2 are engaged with the main lamp 3. The assembly process includes the following steps: Firstly, the four limiting protrusions 6 on the driving plate 1 are inserted into the notch 8 of the slot 7 on the driving plate 1. Secondly, the driving plate 1 continues to slide until the limiting protrusions 6 on the hanging plate 2 press against the bump 9 in the slot 7. Then, the limiting protrusions 6 will deform the bump 9 and push the bump 9 into the tail of the slot 7. After that, the bump 9 will be reset due to its own elastic force, and a sound of the reset bounce will be heard. At this time, the driving plate 1 and the hanging plate 2 would have been assembled correctly. The two elastic probes 4 on the driving plate 1 are electrically connected to the two contact pieces 5 on the hanging plate 2 after the assembly is completed. Then, four hanging wires on the hanging plate 2 are connected to the hanging wire mounting component 15 on the main lamp 3 and a connector of conducting wires on the hanging plate 2 is inserted into the interface to complete the installation of the lamp.

The foregoing description of the embodiments has been provided for purposes of illustration and description. It is not intended to be exhaustive or to limit the disclosure. Variations or modifications of the embodiments are not to be regarded as a departure from the disclosure, and all such modifications are intended to be included within the scope of the disclosure.

We claim:

1. A dual-purpose panel lamp, comprising a driving plate, a hanging plate, and a main lamp, wherein:

the driving plate comprises an elastic probe;

each of the hanging plate and the main lamp comprises a contact piece for electrically connecting with the elastic probe;

the driving plate is in buckle connection with the hanging plate and the main lamp;

the elastic probe on the driving plate is electrically connected to the contact piece on the hanging plate when the driving plate is engaged with the hanging plate; and the elastic probe on the driving plate is electrically connected to the contact piece on the main lamp when the driving plate is engaged with the main lamp.

2. The lamp of claim 1, wherein the buckle connection includes coupling the driving plate to the hanging plate or the main lamp through a slot and a limiting protrusion, wherein one side of the slot has a notch for the limiting protrusion to extend into, and wherein the other side of the slot has a bump for limiting the limiting protrusion within the slot.

3. The lamp of claim 2, further comprising an auxiliary groove positioned away from the side having the notch, the auxiliary groove having a recess positioned near the bump.

4. The lamp of claim 3, wherein the main lamp includes a frame, a frame mounting component for mounting the frame, and an LED chip disposed at a side of the frame, and the frame mounting component is disposed on top of the LED chip.

5. The lamp of claim 4, wherein the main lamp comprises a hanging wire mounting component connected to the hanging plate and a lamp body mounting component connected to the driving plate, at least one reinforcing component is disposed in the main lamp, and the hanging wire mounting component and the lamp body mounting component are both provided on the reinforcing component.

6. The lamp of claim 5, the hanging plate includes a hanging plate mounting component for connecting to the driving plate and an outer cover disposed under the hanging plate mounting component, and the edges of the outer cover are inclined upwardly.

7. The lamp of claim 6, wherein a background light is disposed on the hanging plate and inside the outer cover.

8. The lamp of claim 7, wherein the lamp comprises two elastic probes, two contact pieces, four hanging wire mounting members, and four limiting protrusions.

9. The lamp of claim 8, wherein the bump is under the lower side of the slot and close to an end point of the slot.

10. An installation method for a dual-purpose panel lamp of claim 9, comprising the steps of:

sliding the limiting protrusions on the hanging plate into the slot on the driving plate;

sliding the driving plate to cause the limiting protrusions to deform the bump in the slot and push the bump into an end of the slot;

electrically connecting the two elastic probes with the two contact pieces after the bump is reset; and connecting the four hanging wires on the hanging plate to the four hanging wire mounting components.

* * * * *